US006646624B1

(12) United States Patent
Masumori et al.

(10) Patent No.: US 6,646,624 B1
(45) Date of Patent: Nov. 11, 2003

(54) AC PLASMA DISPLAY DEVICE

(75) Inventors: Tadayuki Masumori, Osaka (JP); Yukiharu Ito, Takatsuki (JP); Koichi Itsuda, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/362,240

(22) Filed: Jul. 28, 1999

(30) Foreign Application Priority Data

Jul. 30, 1998 (JP) ..... 10-215246

(51) Int. Cl.[7] ..... G09G 3/28
(52) U.S. Cl. ..... 345/60; 345/55; 345/67
(58) Field of Search ..... 345/60, 67, 55

(56) References Cited

U.S. PATENT DOCUMENTS 5,410,219 A * 4/1995 Takei et al. ..... 315/169.4
5,420,602 A * 5/1995 Kanazawa ..... 345/67
6,252,574 B1 * 6/2001 Hosoi et al. ..... 345/103

FOREIGN PATENT DOCUMENTS

EP 0 508 053 10/1992
EP 0 549 275 6/1993
EP 0 896 316 2/1999
JP 6-4039 1/1994
JP 10-149131 5/2000

* cited by examiner

*Primary Examiner*—Matthew C. Bella
*Assistant Examiner*—Mackly Monestime
(74) *Attorney, Agent, or Firm*—Wenderoth, Lind & Ponack, L.L.P.

(57) ABSTRACT

An AC plasma display device includes a pair of spaced apart first and second plates. The first plate bears electrodes each extending in a first direction, and the second plate bears paired first and second electrodes each extending in another direction perpendicular to the first direction. The paired first and second electrodes are divided into several groups. Further, the device includes first connecting lines connected to each other, each of which is associated with the first electrodes in one of the groups. Also provided are second connecting lines connected to each other, each of which is associated with the second electrodes in one of the groups. In addition, the device includes first pulse generators, each of which is associated with one of the first connecting lines and second pulse generators, each of which is associated with one of the second connecting lines.

4 Claims, 11 Drawing Sheets

AC PLASMA DISPLAY DEVICE

FIELD OF THE INVENTION

The present invention relates to an AC plasma display device and, in particular, to an electric circuit for use with the AC plasma display device.

BACKGROUND OF THE INVENTION

FIG. 9 shows a conventional drive circuit for use with an AC plasma display panel of an AC plasma display device. The AC plasma display panel (hereinafter referred to as "panel" as necessary), generally indicated by reference numeral 1, includes M data electrodes $D_{1-m}$ extending vertically and 2N pairs of sustain and scan electrodes, $SUS_{1-2N}$ and $SCN_{1-2N}$, extending horizontally. The vertically extended data electrodes $D_{1-m}$ face to the horizontally extended sustain and scan electrodes, $SUS_{1-2N}$ and $SCN_{1-2N}$, leaving a small space gap therebetween. The sustain and scan electrodes, $SUS_{1-2N}$ and $SCN_{1-2N}$, are divided into two groups or blocks; the first group or block 2 including sustain and scan electrodes, $SUS_{1-N}$ and $SCN_{1-N}$, and the second group or block 3 including sustain and scan electrodes, $SUS_{(N+1)-2N}$ and $SCN_{(N+1)-2N}$.

The data electrodes $D_{1-M}$ are electrically connected with a data driver 4 having a pulse generator not shown for applying a drive signal or pulse voltage to each of the data electrodes $D_{1-M}$. The sustain and scan electrodes, $SUS_{1-N}$ and $SCN_{1-N}$, in the first group 2 are connected to sustain and scan drivers, 5 and 6, respectively. On the other hand, the sustain and scan electrodes, $SUS_{(N+1)-2N}$ and $SCN_{(N+1)-2N}$, in the second group 3 are connected to sustain and scan drivers, 7 and 8, respectively.

The sustain drivers 5 and 7 include sustain/erase (S/E) pulse generators 9 and 10, respectively. Also, the S/E pulse generator 9 is electrically connected at its output through an output line 11 with each of the sustain electrodes $SUS_{1-N}$ so that the pulse generator 9 applies a certain signal or pulse voltage to each of the sustain electrodes $SUS_{1-N}$. Likewise, the S/E pulse generator 10 is electrically connected at its output through an output line 12 with each of the sustain electrodes $SUS_{(N+1)-2N}$ so that the pulse generator 10 applies a certain signal or pulse voltage to each of the sustain electrodes $SUS_{(N+1)-2N}$.

The scan driver 6 includes a scan/sustain (S/S) pulse generator 13 and switching circuit 14, and the scan driver 8 includes a S/S pulse generator 15 and switching circuit 16. The S/S pulse generator 13 is electrically connected at its output through an output line 17 with the switching circuit 14, which in turn connected with each of the scan electrodes $SCN_{1-N}$. This allows the pulse generator 13 to apply a certain signal or pulse voltage to each of the scan electrodes $SCN_{1-N}$. Likewise, the S/S pulse generator 15 is electrically connected at its output through an output line 18 with the switching circuit 16, which in turn connected with each of the scan electrodes $SCN_{(N+1)-2N}$. This allows the pulse generator 15 to apply a certain signal or pulse voltage to each of the scan electrodes $SCN_{(N+1)-2N}$.

In operation of the AC plasma display panel so constructed, the data, sustain and scan electrodes are applied with respective pulses. A process for displaying an instant image in the panel includes three steps or periods; writing, sustaining and erasing periods. In the first writing period or step, the predetermined writing pulse or signal is sequentially applied to each of the scan electrodes $SCN_{1-2N}$, during which another predetermined pulse voltage or signal is applied to selected one or more of the data electrodes $D_{1-M}$, according to the image to be displayed. This induces an electric discharge at discharge cells or pixel cells formed adjacent to intersections of the scan and data electrodes and corresponding to the selected data electrodes.

In the next sustaining period, the sustain electrodes $SUS_{1-2N}$ are applied with the predetermined sustain pulse voltage or signal, thereby sustaining the discharge at each of the selected discharge cells or image pixels according to the display data.

Finally, in the last erasing period, the predetermined erase pulse voltage or signal is applied to the sustain electrodes $SUS_{1-2N}$ to erase the residual electric discharge.

In the writing period, the switching circuits 14 and 16 switch the pulse voltages transmitted from the S/S pulse generators 13 and 15, respectively, so that the scan electrodes $SCN_{1-N}$ and $SCN_{(N+1)-2N}$ are applied with the predetermined pulse voltage in sequential order. Likewise, in the sustaining period, the predetermined pulse voltage transmitted from the S/S pulse generators 13 and 15 are applied to respective scan electrodes $SCN_{1-N}$ and $SCN_{(N+1)-2N}$.

In the meantime, as best shown in FIG. 10, the conventional S/E pulse generators 9 and 10, S/S pulse generators 13 and 15, and the switching circuits 14 and 16 are mainly constructed with push-pull circuit of Field-Effect Transistors (FETs), for example. It should be noted that, for example, where a push-pull circuit is made of two FETs, $X_1$ and $X_2$, it is indicated as "push-pull circuit $X_1/X_2$" hereinafter.

With the arrangement shown in FIG. 10, in the sustaining period, when $FET(Q_2)$ is kept off, the push-pull circuit $Q_1/Q_3$ switches $FET(Q_1)$ and $FET(Q_3)$ alternately. Also, when the $FET(Sa_{1-N})$ are turned on, $FET(Sb_{1-N})$ off, and $FET(T_3)$ off, the push-pull circuit $T_1/T_2$ switches $FET(T_1)$ and $FET(T_2)$ alternately, with a certain phase opposite to that of the push-pull circuit $Q_1/Q_3$. This allows a pulse voltage of −Vm volts to be applied to the sustain electrodes $SCN_{1-N}$ and scan electrodes $SCN_{1-N}$ alternately. Also, the sustain pulse voltage is applied to the sustain electrodes $SUS_{(N+1)-2N}$ in the same timing as the sustain electrodes $SUS_{1-N}$, and to the scan electrodes $SCN_{(N+1)-2N}$ in the same timing as the $SCN_{1-N}$.

In FIG. 9, suppose that a load for sustaining the discharge in a first region corresponding to the group 2 (upper half) is equal to that for sustaining the discharge in a second region corresponding to the group 3 (lower half). In other words, assume that an image is displayed in the whole area of the panel with a constant brightness. In this instance, an electric current flowing from the sustain electrodes $SUS_{1-N}$ to the S/E pulse generator 9 is equal to another electric current flowing from the sustain electrodes $SUS_{(N+1)-2N}$ to the S/E pulse generator 10 (i.e., Iua=Iub), and an electric current flowing from the scan electrodes $SCN_{1-N}$ to the S/S pulse generator 13 is equal to another electric current flowing from the scan electrodes $SCN_{(N+1)-2N}$ to the S/S pulse generator 15 (i.e., Ica=Icb).

It should be noted that the actual driver circuit includes resistance of lines and electric elements such as FETs. Therefor, the driver circuit is designed so that resistance from the power supply of −Vm volts for the S/E pulse generator 9 to the sustain electrodes $SUS_{1-N}$ is equal to that from the power supply for the S/E pulse generator 10 to the sustain electrodes SUS and a resistance from the power supply of −Vm volts for the S/S pulse generator 13 to the scan electrodes $SCN_{1-N}$ is equal to that from the power supply for the S/S pulse generator 15 to the scan electrodes $SCN_{(N+1)-2N}$.

However, when displaying an image having its major part positioned in the first region (upper half) and its minor part positioned in the second region (lower half) with a constant brightness in its entire image area as shown in FIG. 11, in the sustaining period, the load for sustaining the discharge in the first region becomes greater than that in the second region. Therefore, the discharge current Iua flowing from the sustain electrodes $SUS_{1-N}$ to the S/E pulse generator 9 and the discharge current Ica flowing from the $SCN_{1-N}$ to the S/S pulse generator 13 become greater than the discharge current Iub from the sustain electrodes $SUS_{(N+1)-2N}$ to the S/E pulse generator 10 and the discharge current Icb from the $SCN_{(N+1)-2N}$ to the S/S pulse generator 15, respectively. This in turn results in that a voltage drop from the power source of −Vm volts for the S/E pulse generator 9 and S/S pulse generator 13 to the sustain electrodes $SUS_{1-N}$ and scan electrodes $SCN_{1-N}$ becomes greater than that from the power source for the S/E pulse generator 10 and S/S pulse generator 15 to the sustain electrodes $SUS_{(N+1)-2N}$ and scan electrodes $SCN_{(N+1)-2N}$. Then, an effective pulse voltage applied to the sustain electrodes $SUS_{1-N}$ and scan electrodes $SCN_{1-N}$ becomes lower than that to the sustain electrodes $SUS_{(N+1)-2N}$ and scan electrodes $SCN_{(N-)-2N}$, respectively, which further results in that an intensity of the sustaining discharge between the sustain electrodes $SUS_{1-N}$ and scan electrodes $SCN_{1-N}$ becomes lower than that between $SUS_{(N+1)-2N}$ and $SCN_{(N+1)-2N}$. This lowers the brightness in the first area of the group 2 than that in the second area of the group 3, leading to an unevenness of the brightness in the displayed image.

SUMMARY OF THE INVENTION

Accordingly, an object of the present invention is to provide an AC plasma display device capable of displaying an image with an even brightness, and another object of the present invention is to provide an electric circuit for preferably use in the AC plasma display device.

An AC plasma display device of the present invention includes a pair of spaced apart first and second plates. The first plate bears a plurality of electrodes each extending in a first direction, and the second plate bears a plurality of paired first and second electrodes each extending in another direction perpendicular to the first direction. The paired first and second electrodes are divided into a plurality of groups.

Further, the device includes a plurality of first connecting lines. Each of the first connecting lines is associated with the first electrodes in one of the plurality of groups, and the first connecting lines are connected to each other. Also provided are a plurality of second connecting lines. Each of the second connecting lines is associated with the second electrodes in one of the plurality of groups, and the second connecting lines are connected to each other.

In addition, the device includes a plurality of first pulse generators. Each of the first pulse generators is associated with one of the first connecting lines. Also provided are a plurality of second pulse generators. Each of the second pulse generators is associated with one of the second connecting lines.

In another aspect of the present invention, each of the first electrodes in each of the groups is extended out on one side of the plate and each of the second electrodes in each of the groups is extended out on the opposite side of the plate.

In another aspect of the present invention, the first electrodes in one of the plurality of groups are extended out on one side of the plate, and the first electrodes in another of the plurality of groups are extended out on the opposite side of the plate. Also, the second electrodes in the one of the plurality of groups are extended out on the opposite side of the plate, and the second electrodes in the another of the plurality of groups are extended out on the one side of the plate.

In another aspect of the present invention, the device further includes a plurality of first and second circuit boards. Each of the first circuit boards supports one of the first pulse generators. Also, each of the second circuit boards supports one of the second pulse generators.

Also, another AC plasma display panel has a display having first and second display regions and a plurality pairs of sustaining and scanning electrodes. The plurality of pairs are divided into first and second groups so that the first and second groups are assigned to the first and second display regions, respectively. Further provided are a sustaining electrode driver for driving the sustaining electrodes and a scanning electrode driver for driving the scanning electrodes. In addition, means is provided for providing the first and second display regions with the same brightness even if the first region is greater or smaller in size than the second region.

DETAILED DESCRIPTION OF THE PREFERRED EMBODIMENTS

Figure 6:
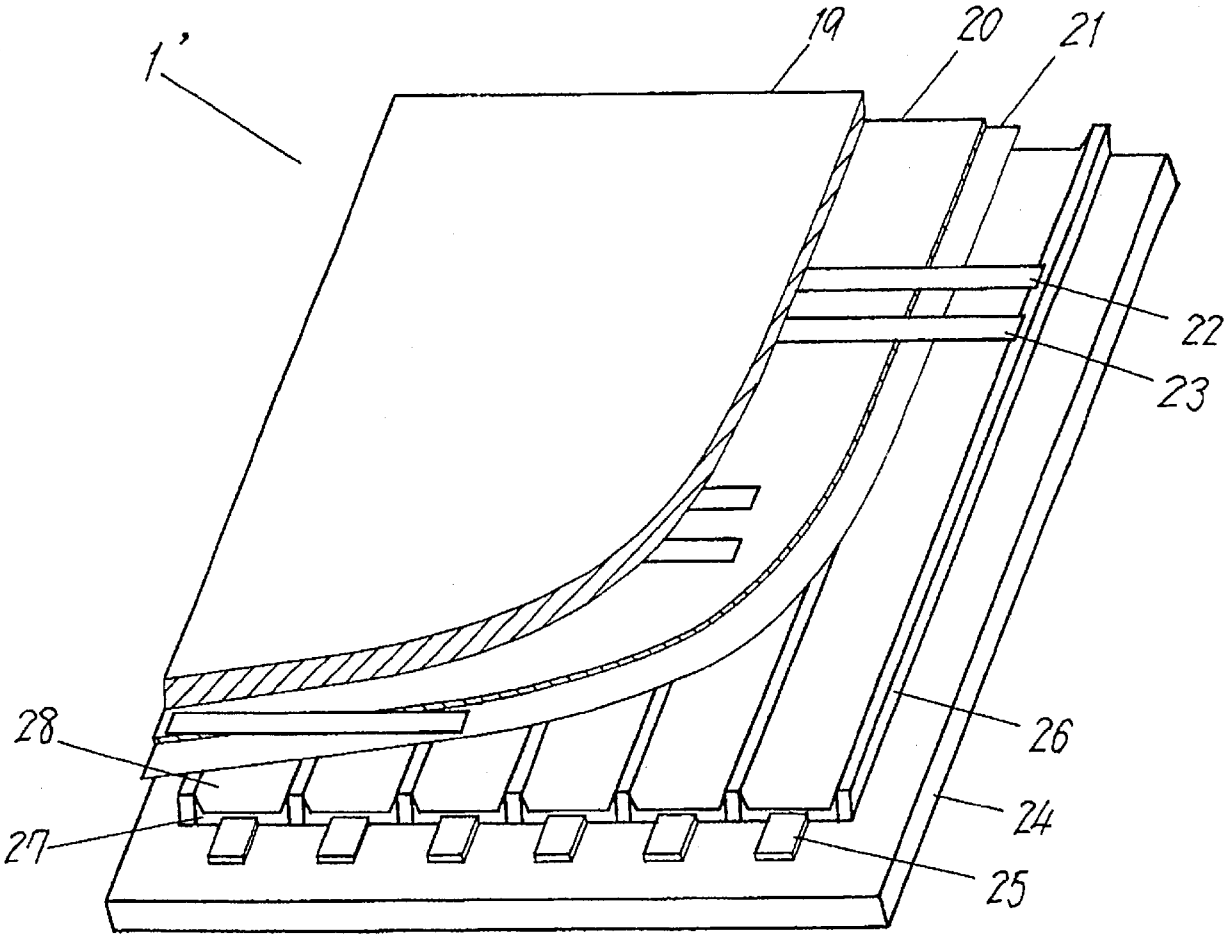
FIG. 6 is a partial perspective view of the AC plasma display panel according to the present invention.

FIG. 6 illustrates a part of an AC plasma display panel (referred to as "panel" as necessary) for use in an AC plasma display apparatus, generally indicated by reference numeral 1'. The panel 1' includes a first insulating plate or substrate 19 bearing dielectric and protection layers, 20 and 21, in this order. Provided between the dielectric and protection layers, 20 and 21, are a plurality pairs of sustain and scan electrodes, 22 and 23, extending in a parallel fashion so that each of the sustain electrodes 22 pairs with and runs aside each of the scan electrodes 23. The panel 1' also includes a second insulating plate or substrate 24 bearing a plurality of data electrodes 25 and a plurality of partitions or ribs 26 extending in a parallel fashion so that each data electrode 25 positions between neighboring ribs 26. Applied between each of the neighboring ribs 26 is a fluorescent material 27 covering the side surfaces of the ribs 26 and corresponding data electrode 25 between the ribs 26. The first and second plates 19 and 24 are assembled to each other so that the sustain and scan electrodes, 22 and 23, extend perpendicular to the data electrodes 25 and also the protection layer 21 faces to the ribs 26, forming a discharging chamber 28 on each of the data electrodes 25. The neighboring sustain and scan electrodes, 22 and 23, cooperate with each other so that, in a sustaining period or step, pulses are alternately applied to the sustain and scan electrodes, 22 and 23, to sustain discharges between the paired electrodes 22 and 23 for an image display.

Figure 7:
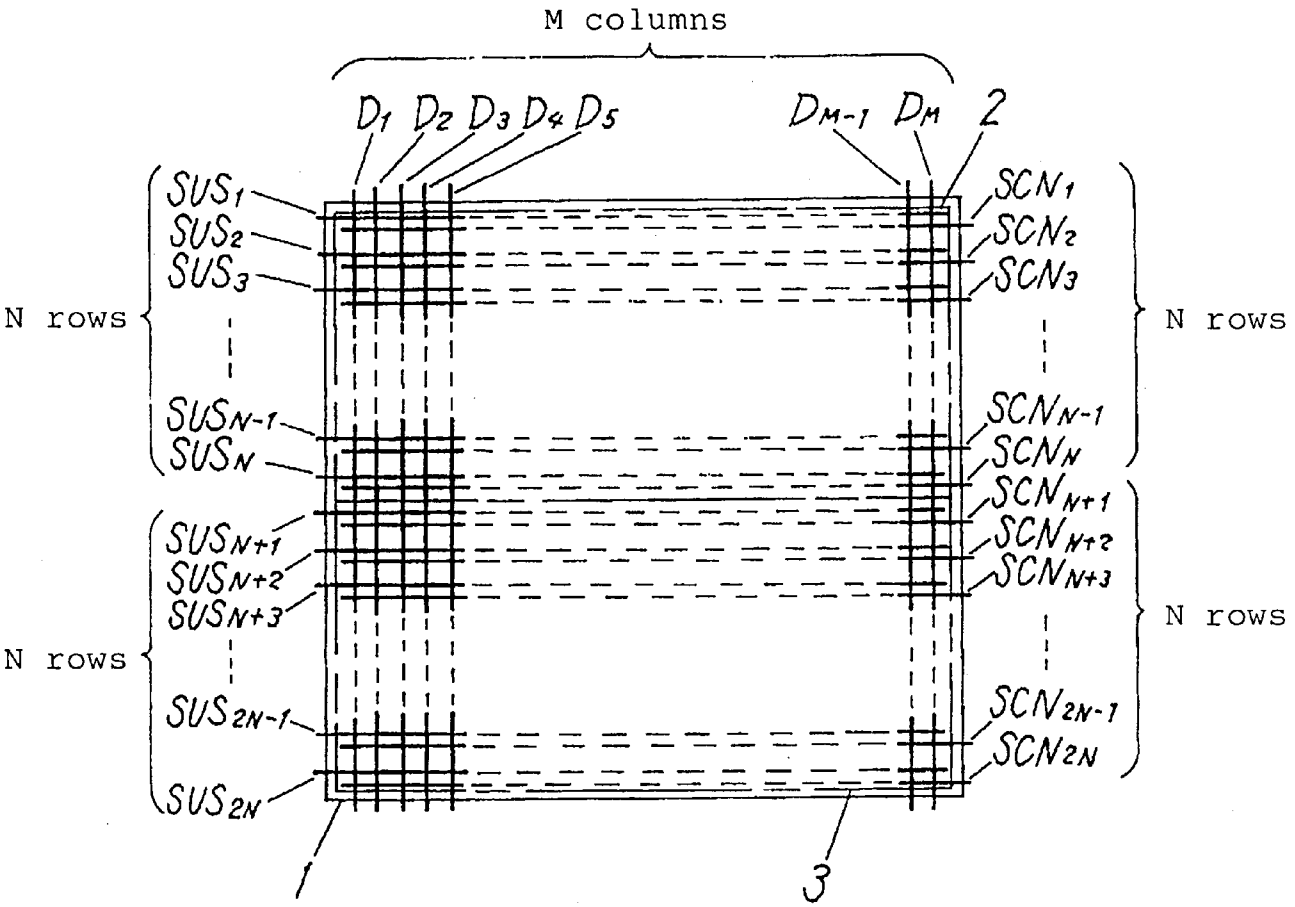
FIG. 7 is an arrangement of electrodes in the AC plasma display panel.

FIG. 7 shows an arrangement of the electrodes in the panel 1, which defines a large M by 2N matrix having first and second M by N small matrixes corresponding to first and second groups or blocks 2 and 3. Specifically, the large matrix includes M columns of data electrodes $D_{1-M}$ commonly used for the two small matrixes or groups 2 and 3. Also, the large matrix includes N rows of sustain electrodes SUS,N and N rows of scan electrodes $SCN_{1-N}$ for the first group 2, and N rows of sustain electrodes $SUS_{(N+)-2N}$ and N rows of scan electrodes $SCN_{(N+1)-2N}$ for the second group 3. Namely, the arrangement has 2N pairs of sustain and scan electrodes, grouped into two parts.

Figure 8:
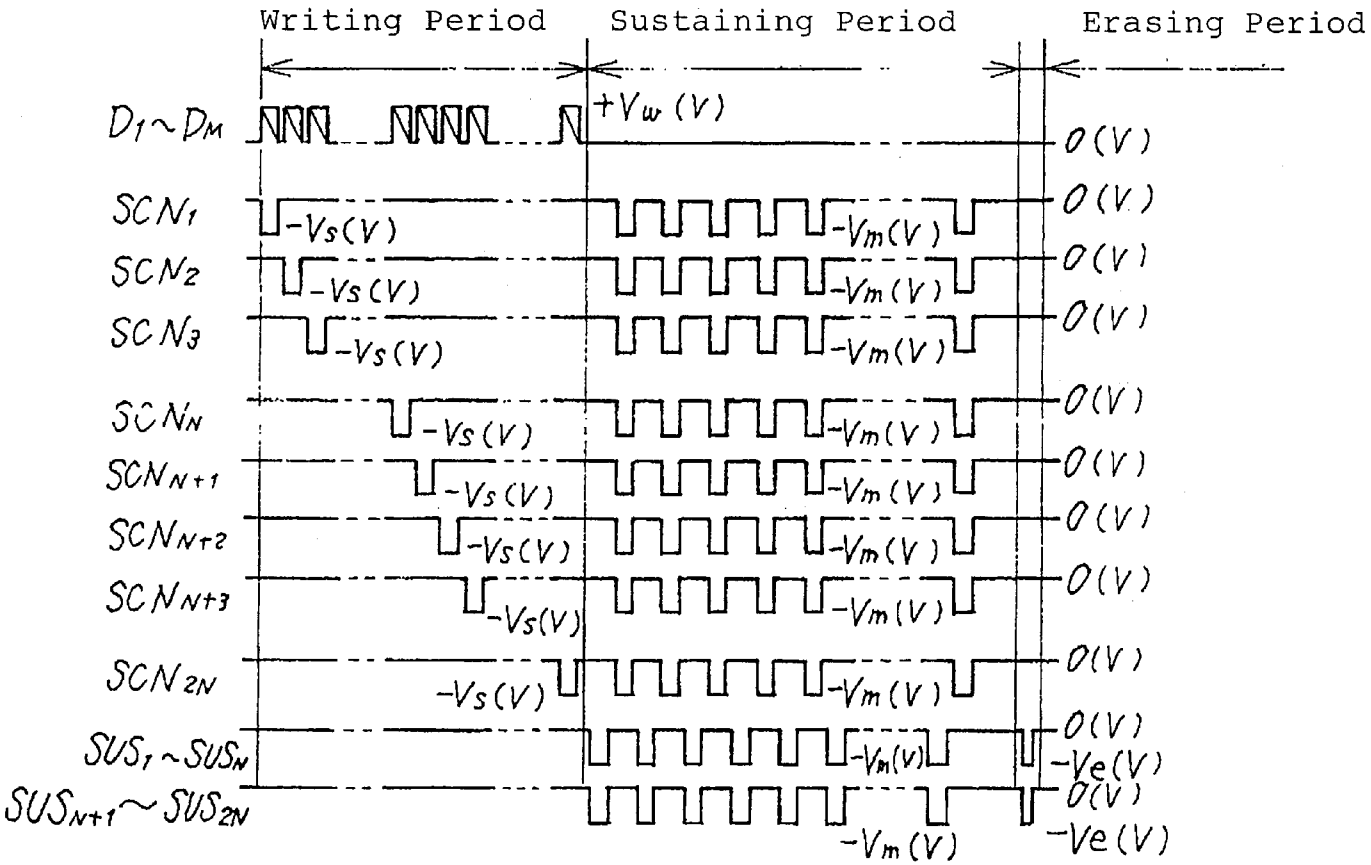
FIG. 8 is a timing chart for driving AC plasma display device.

Referring to FIG. 8 which illustrates timing charts of the panel, operations of the panel 1 so constructed will be described in detail hereinafter. As shown in the drawing, during the writing period, all the sustain electrodes $SUS_{1-2N}$ are sustained at a constant voltage, i.e., zero volt. In this writing period, for the first row or line of a displaying image, the biased data electrodes selected among $D_{1-M}$ according to the image are applied with a pulse of $+V_W$ volts having a positive polarity, while the scan electrode $SCN_1$ is applied with another pulse of $-V_S$ volts having a negative polarity. This generates an electric discharge at intersections of the biased data electrodes and scan electrode $SCN_1$. As a result, surface portions of the protection layer 21 adjacent to the intersections are provided with the positive charge.

Likewise, for the next scanning for the second line, the biased data electrodes selected among $D_{1-M}$ are applied with the pulse of $+V_W$ volts, while the scan electrode $SCN_2$ of the second line is applied with the pulse of $-V_S$ volts. This causes the electric discharge at corresponding intersections of the biased data electrodes and the scan electrode $SCN_2$. This results in that surface portions of the protection layer 21 corresponding to the intersections are provided with the positive charge.

Like operations are performed for all the rest of the scan electrodes $SCN_3$ to $SCN_{2N}$, which results in that the surface portions of the protection layer 21 corresponding to the intersections of the biased data and scan electrodes are charged with certain voltage.

Next, in the sustaining period or step, all the sustain electrodes $SUS_{1-2N}$ and the scan electrodes $SCN_{1-2N}$ are applied with pulse voltage of −Vm volts alternately. This sustains the electric discharge generated at the intersections of the scan electrodes $SCN_{1-2N}$ and sustain electrodes $SUS_{1-2N}$. The sustained electric discharges emit light, which is used for the display of the displaying image.

Then, in the erasing time, to erase residual charge, all the sustain electrodes $SUS_{1-2N}$ are applied with an erasing pulse voltage of −Ve volts having negative polarity. This, causes an erasing discharge at each intersection to erase the sustaining discharge.

With such series of operations, one instant image is displayed on the panel. Therefore, in an actual image formation, the series of the operations are performed sequentially.

Figure 1:
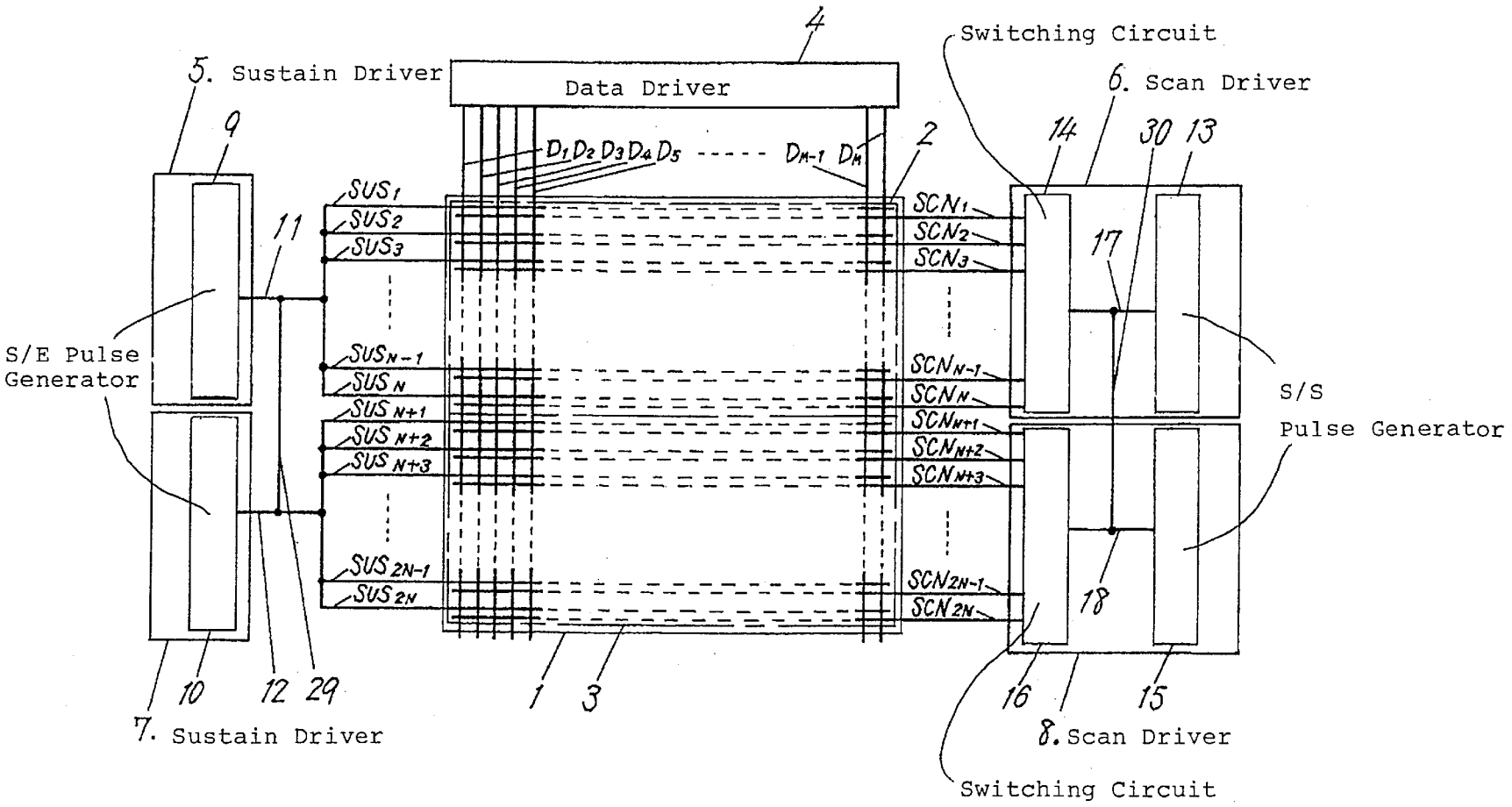
FIG. 1 is a circuit diagram of an AC plasma display device according to the present invention.
Figure 9:
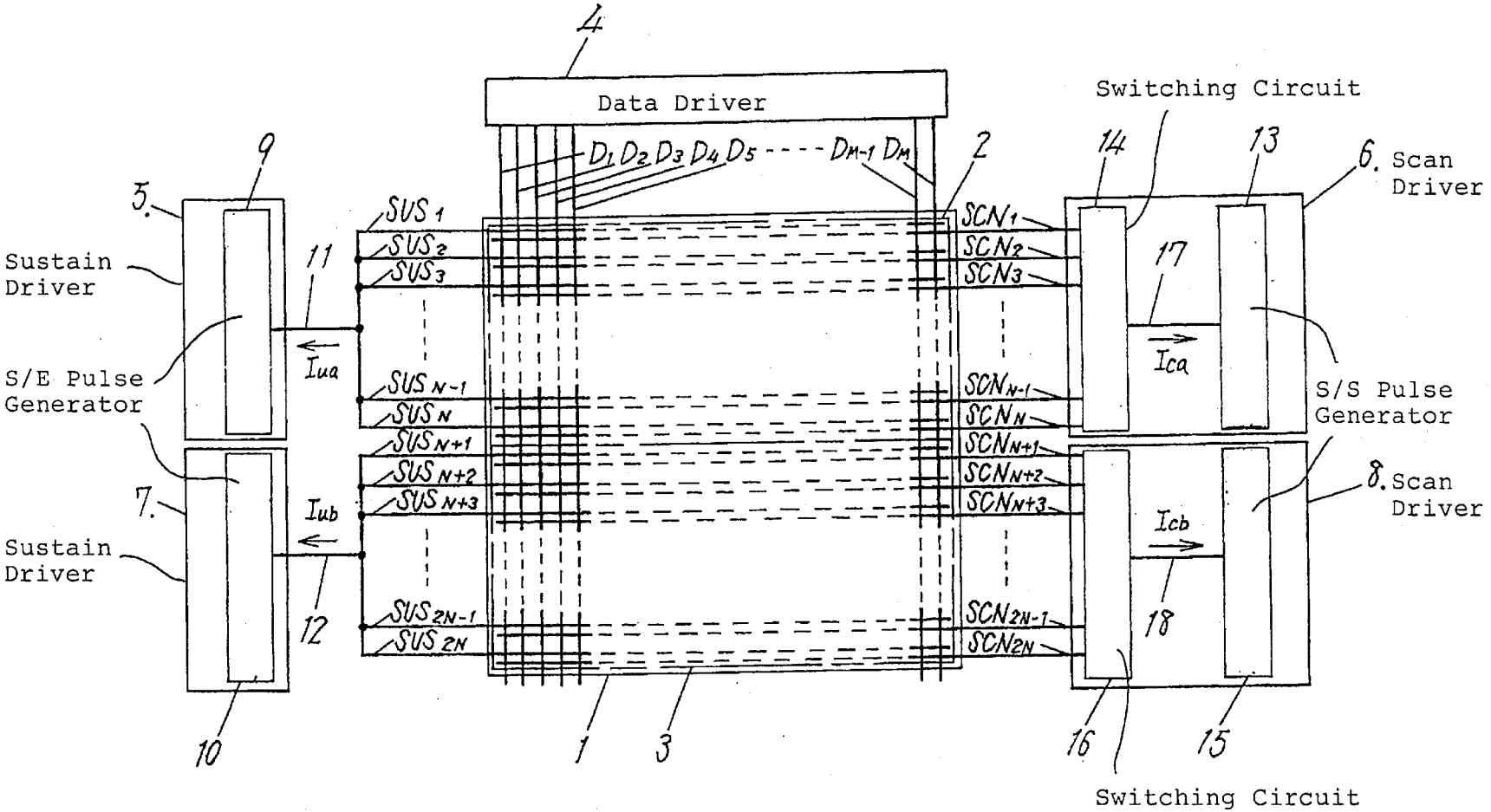
Fig. 9 PRIOR ART
FIG. 9 is a circuit diagram of the prior art AC plasma display panel.
Figure 10B:
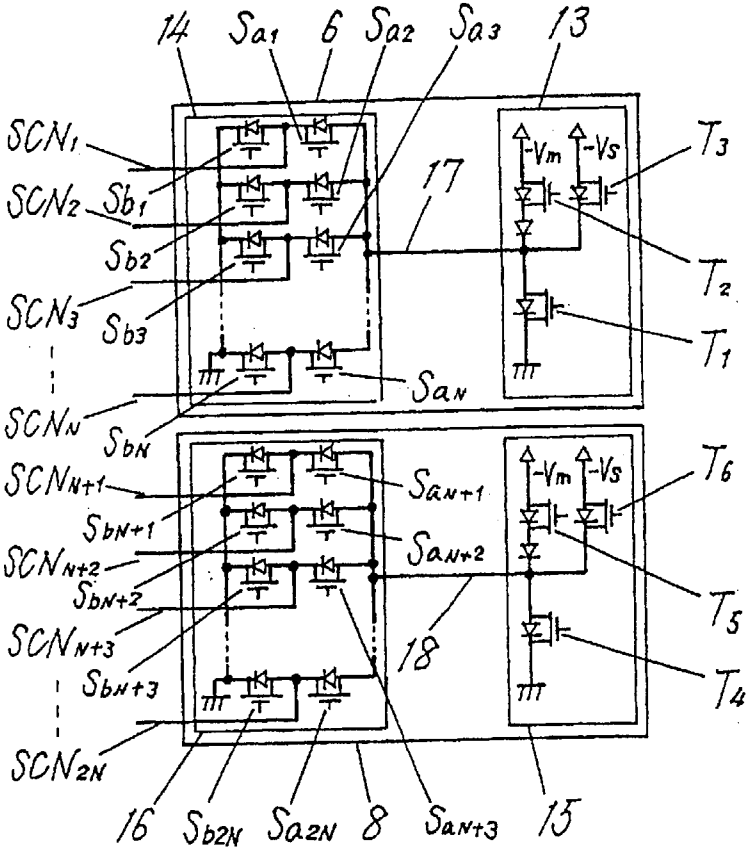
Fig. 10B PRIOR ART
FIG. 10B is a prior art circuit diagram of scan drivers each having a switching circuit for driving the AC plasma display panel.
Figure 10A:
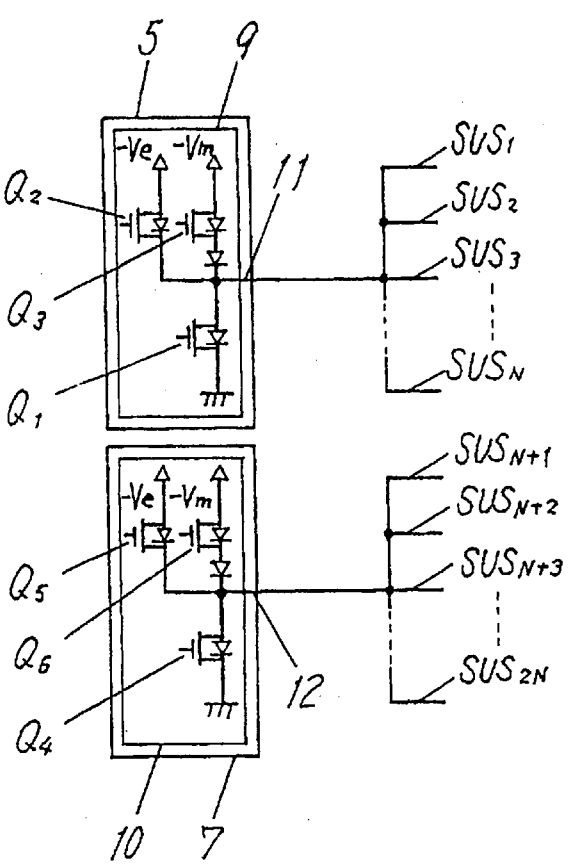
Fig. 10A PRIOR ART
FIG. 10A is a prior art circuit diagram of sustain drivers for driving the AC plasma display panel.
Figure 11:
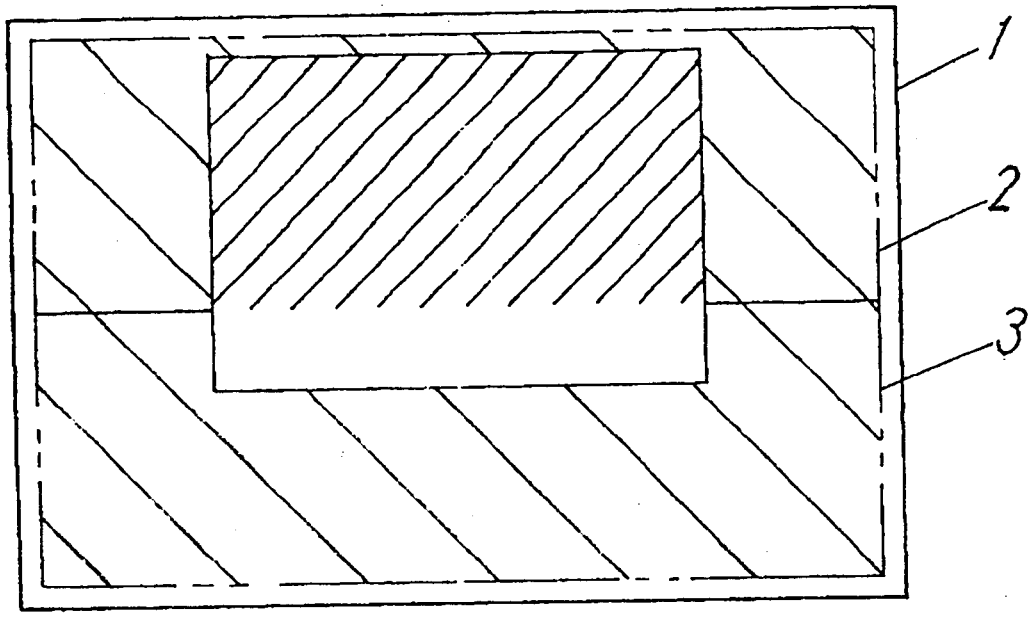
FIG. 11 is a plan view of the prior art AC plasma display panel in which an image is displayed across two imaging blocks.

FIG. 1 shows an embodiment of the AC plasma display device that incorporates the panel 1'. The AC plasma display panel is similar to the conventional AC plasma display panel illustrated in FIG. 9 except that an output line 11 of a S/E pulse generator 9 for the sustain electrodes $SUS_{1-N}$ and an output line 12 of a S/E pulse generator 10 for the sustain electrodes $SUS_{(N+1)-2N}$ are electrically connected through a bypass line 29. In addition, an output line 17 between an switching circuit 14 and a S/S pulse generator 13 for the sustain electrodes $SUS_{1-N}$ and an output line 18 between an switching circuit 16 and a S/S pulse generator 15 for the sustain electrodes $SUS_{(N+1)-2N}$ are electrically connected through another bypass line 30. The bypass lines 29 and 30 may be any electrically conductive element.

Figure 2B:
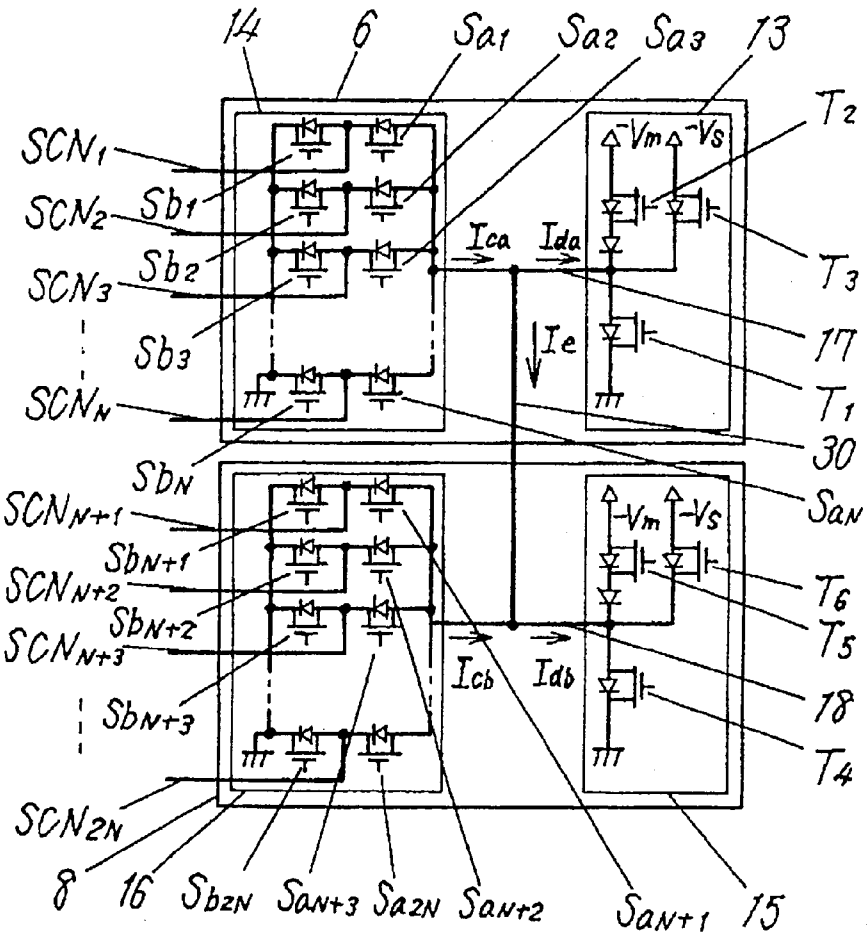
FIG. 2B is a circuit diagram of scan drivers according to the present invention each having a switching circuit for driving the AC plasma display panel.
Figure 2A:
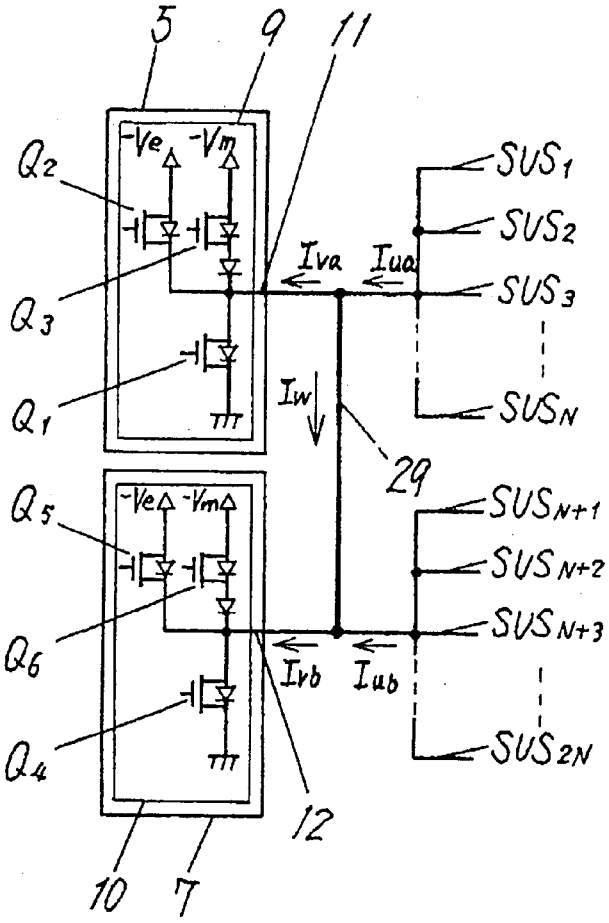
FIG. 2A is a circuit diagram of sustain drivers according to the present invention for driving the AC plasma display panel.

FIGS. 2A and 2B illustrate details of examples of S/E pulse generator 9, NM/E generator 10, S/S pulse generator 13, S/S pulse generator 15, switching circuit 14, and switching circuit 16. As can be seen in the drawings, in which each of the circuits has push-pull circuits each made of field effect transistors (FET).

Specifically, as shown in FIG. 2A, the S/E pulse generator 9 includes $FET(Q_1)$, $FET(Q_2)$, and $FET(Q_3)$. The $FET(Q_1)$ is grounded at its source, and connected at its drain with sources of the $FET(Q_2)$ and $FET(Q_3)$. The $FET(Q_1)$, $FET(Q_2)$ and $FET(Q_3)$ are also connected through the output line 11 with the sustain electrodes $SUS_{1-N}$. The $FET(Q_2)$ is also connected at its drain with a power source so that it is applied with −Ve volts from the power source. The $FET(Q_3)$, on the other hand, is connected at its drain with another power source so that it is applied with −Vm volts from the power source. The S/E pulse generator 10, which includes $FET(Q_4)$, $FET(Q_5)$ and $FET(Q_6)$, has substantially the same circuit structure as the S/E pulse generator 9 and is connected through an output line 12 with the sustain electrodes $SUS_{(N+1)-2N}$, Also, the output lines 11 and 12 are connected by a bypass line 29.

The S/S pulse generator 13 includes $FET(T_1)$, $FET(T_2)$ and $FET(T_3)$. The $FET(T_1)$ is grounded at its source. On the other hand, the $FET(T_1)$ is connected at its drain with sources of $FET(T_2)$ and $FET(T_3)$, and a connection of these $FET(T_1)$, $FET(T_2)$ and $FET(T_3)$ is connected through an ouptut line 17 with the switching circuit 14. In addition, the $FET(T_2)$ is connected at its drain with the power source of −Vm volts, and the $FET(T_3)$ is connected at its drain with the power source of −Vs volts.

The switching circuit 14 also includes $FET(Sa_{1-N})$ and $FET(Sb_{1-N})$. The $FET(Sa_{1-N})$ are connected at their drains with a common line or output line 17 and connected at their sources with respective drains of the $FET(Sb_{1-N})$ whose sources are grounded. In addition, the $FET(Sa_{1-N})$ are connected at their sources with respective scan electrodes $SCN_{1-N}$.

The S/S pulse generator 15 includes $FET(T_4)$, $FET(T_5)$, and $FET(T_6)$, connected with the sustain electrodes $SUS_{(N+1)-2N}$ through the output line 18. Also, the $FET(T_4)$, FET($T_5$), and FET($T_6$) are connected to each other and to the power sources as described for the FET($Q_1$), FET($Q_2$), and FET($Q_3$), respectively. The switching circuit 16 includes FET($Sa_{(N+1)-2N}$) and FET($Sb_{(N+1)-2N}$), connected to each other and grounded as the FET($Sa_{1-N}$) and FET($Sb_{(N+1)-2N}$).

In operation of the AC plasma display device so constructed, in the sustaining period, the FET ($Q_2$) is turned off while the push-pull circuit $Q_1/Q_3$ switches FET ($Q_1$) and FET ($Q_2$) alternately. Also, when the FET($Sa_{1-N}$) are tuned on and the FET($Sb_1$) as well as the FET ($T_3$) are turned off, the push-pull circuit $T_1/T_2$ switches FET($T_1$) and FET($T_2$) alternately. It should be noted that the on-off timing of the FET($T_1$) and FET($T_2$) corresponds to off-on timing of the FET($Q_1$) and FET($Q_2$). This results in that the sustain electrodes $SUS_{1-N}$ and $SCN_{1-N}$ are alternately applied with the sustaining pulse of −Vm volts at different periods. That is, the pulse voltage to be applied to the sustain electrodes $SUS_{1-N}$ is opposite in phase to that to the scan electrodes $SCN_{1-N}$. The sustaining pulse voltage is applied to the sustain electrodes $SUS_{(N+1)-2N}$ in the same timing as the sustain electrodes $SUS_{1-N}$ and to the scan electrodes $SCN_{(N+1)-2N}$ in the same timing as the scan electrodes $SCN_{1-N}$.

In the scanning or sustaining period, when the FET($Q_1$) and FET($Q_4$) are turned on; FET($Q_2$), FET($Q_3$), FET($Q_5$), and FET($Q_6$) are turned off; and FET($T_2$) and FET($T_5$) are turned off, the push-pull circuit $T_1/T_3$ as well as $T_4/T_6$ switches alternately in the same timing. In synchronism with this on-off timing of the FETs, from a condition in which the FET($Sa_{1-2N}$) are turned off and the FET($Sb_{1-2N}$) are tuned on, the push-pull circuits $Sa_1/Sb_1$, $Sa_2/Sb_2$, . . . , and $Sa_{2N}/Sn_{2N}$, are switches corresponding FETs sequentially. This causes the scan electrodes $SCN_1$, $SCN_2$, . . . , $SCN_{2N}$ to be applied with the scanning pulse voltage of −Vs volts in this order.

In the erasing period, when the FET($T_1$) and FET($T_4$) are turned on; FET($T_2$), FET($T_3$), FET($T_5$), and FET ($T_6$) are turned off; FET($Sa_{1-2N}$) are turned off; FET($Sb_{1-2N}$) are turned on; and FET($Q_2$) and FET($Q_5$) turned off, from a condition in which the FET($Q_1$) and FET($Q_4$) are turned on and FET ($Q_2$) and FET($Q_5$) are turned off, the push-pull circuits $Q_1/Q_2$ and $Q_4/Q_5$ are switched. This causes all the sustain electrodes $SUS_{1-2N}$ to be applied with the erasing pulse voltage of −Ve volts.

The electric circuit illustrated in FIG. 2 is designed to have certain characteristics. Specifically, as described in connection with the prior art plasma display panel, when a load for sustaining discharge in an upper half of the display corresponding to the first group 2 is substantially identical to that the lower half corresponding the second group 3 (i.e., the whole area of the display presents an even brightness), an electric current Iua flowing from the sustain electrodes $SUS_{1-N}$ to the S/E pulse generator 9 is set to be substantially identical to an electric current Iub flowing from the sustain electrodes $SUS_{(N+1)-2N}$ to the S/E pulse generator 10, and also an electric current Ica flowing from the scan electrodes $SCN_{1-N}$ to the S/S pulse generator 13 is set to be substantially identical to an electric current Icb flowing from the scan electrodes $SCN_{(N-1)-2N}$ to the S/S pulse generator 15. For this purpose, for example, although not shown in the circuit of FIG. 2, an actual circuit having various resistances of lines and electric elements such as FETs is designed so that a circuit resistance from the power source of −Vm volts for the S/E pulse generator 9 to the sustain electrodes $SUS_{1-N}$ is substantially equal to that from the power source for the S/E pulse generator 10 to the sustain electrodes $SUS_{(N+1)-2N}$ and also a circuit resistance from the power source of −Vm volts for the S/S pulse generator 13 to the scan electrodes $SCN_{1-N}$ is substantially equal to that from the power source for the S/S pulse generator 15 to the scan electrodes $SCN_{(N+1)-2N}$.

Figure 3:
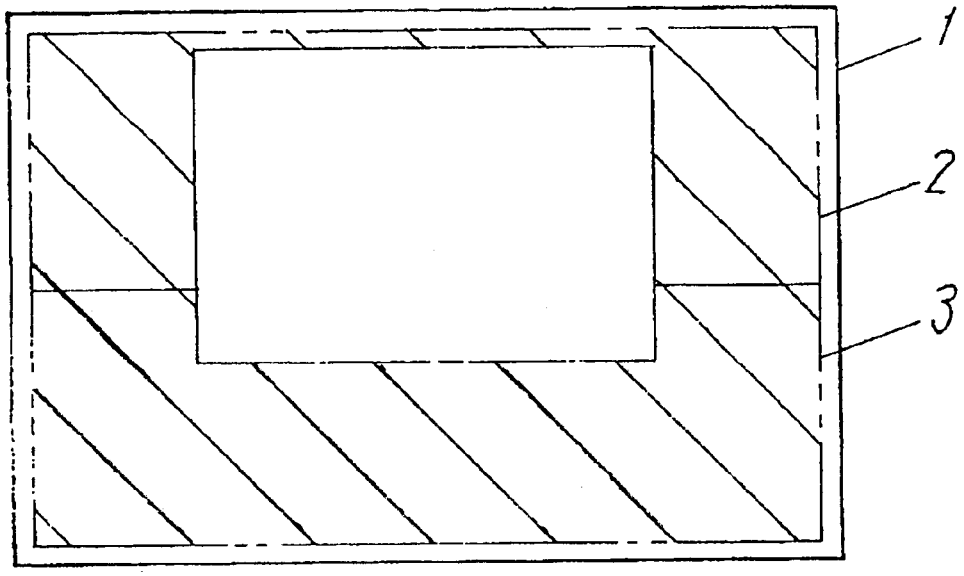
FIG. 3 is a plan view of an AC plasma display panel in which an image is displayed across two imaging blocks.

Suppose that, using the driver circuit shown in FIGS. 1 and 2, an image is displayed in the panel with an even and higher brightness so that a major part of the image is placed in the first region or group 2 (i.e., upper half) and a remaining minor part of the image is placed in the second region or group 3 (i.e., lower half) as shown in FIG. 3. In this instance, due to the difference in area of the images displayed in the first and second regions or groups, 2 and 3, the load for the sustaining discharge in the first region or group 2 becomes greater than that in the second region or group 3. As a result, according to the prior art driver circuit, the electric current Iua for the sustaining discharge from the sustain electrodes $SUS_{1-N}$ and the electric current Ica for the sustaining discharge from the scan electrodes $SCN_{1-N}$ would be greater than those Iub and Icb from $SUS_{(N+1)-2N}$ and $SCN_{(N+1)-2N}$, respectively. (i.e., Iua>Iub and Ica>Icb)

Contrary to this, according to the driver circuit shown in FIG. 2 of the present invention, since the output line 11 of the S/E pulse generator 9 is electrically connected through the bypass line 29 with the output line 12 of the S/E pulse generator 10 and also the output line 17 of the S/S pulse generator 13 is connected through the bypass line 30 with the S/S pulse generator 15, the electric current Iw (=[Iua−Iub]/2) flows in the bypass line 29 and the electric current Ie (=[Ica−Icb]/2) flows in the bypass line 30.

This means that the electric current Iva flowing into the S/E pulse generator 9 equals to the electric current Ivb flowing into another S/E pulse generator 10 as indicated by the following equations (1) and (2):

$$\begin{aligned} Iva &= Iua - Iw \\ &= Iua - [Iua - Iub]/2 \\ &= [Iua + Iub]/2 \end{aligned} \tag{1}$$

$$\begin{aligned} Ivb &= Iub + Iw \\ &= Iub + [Iua - Iub]/2 \\ &= [Iua + Iub]/2 \end{aligned} \tag{2}$$

This also means that the electric current Ida flowing into the S/S pulse generator 13 equals to the electric current Idb flowing into the S/S pulse generator 15 as indicated by the following equations (3) and (4):

$$\begin{aligned} Ida &= Ica - Ie \\ &= Ica - [Ica - Icb]/2 \\ &= [Ica + Icb]/2 \end{aligned} \tag{3}$$

$$\begin{aligned} Idb &= Icb + Ie \\ &= Icb + [Ica - Icb]/2 \\ &= [Ica + Icb]/2 \end{aligned} \tag{4}$$

Therefore, even when the sustaining discharge current Iua from; the sustain electrodes $SUS_{1-N}$, is different from Iub from $SUS_{(N+1)-2N}$ and the sustaining discharge current Ica from the scan electrodes $SCN_{1-N}$ is different from Icb from $SCN_{(N+1)-2N}$, the sustaining discharge current Iva in the S/E pulse generator 9 is kept equal to Ivb in the S/E pulse generator 10 (i.e., Iva=Ivb) and the sustaining discharge current Ida in the S/S pulse generator 13 is kept equal to Ida in the S/S pulse generator 15 (i.e., Ida=Idb).

This allows that voltage drops caused by the circuit resistance from the power source of −Vm volts for the pulse generators 9 and 13 to the electrodes $SUS_{1-N}$ and $SCN_{1-N}$ equal to those caused by the circuit resistance from the power source of −Vm volts for the pulse generators 10 and 15 to the electrodes $SUS_{(N+1)-2N}$ and $SCN_{(N+1)-2N}$, respectively. This in turn results in that effective pulse voltages to be applied to respective electrodes $SUS_{1-N}$ and $SCN_{1-N}$ equal to those to the electrodes $SUS_{(N+1)-2N}$ and $SCN_{(N+1)-2N}$, and also that an intensity of the sustaining discharge between the sustain and scan electrodes, $SUS_{1-N}$ and $SCN_{1-N}$, equals to that between the sustain and scan electrodes, $SUS_{(N+1)-2N}$ and $SCN_{(N+1)-2N}$. Therefore, even at displaying the image having its major part position in the first region for the group 2 and its minor part position in the second region for the group 3, the brightness in the first region is kept substantially equal to that in the second region 3. This ensures the image having an even brightness over the entire image is displayed in the panel.

Figure 4:
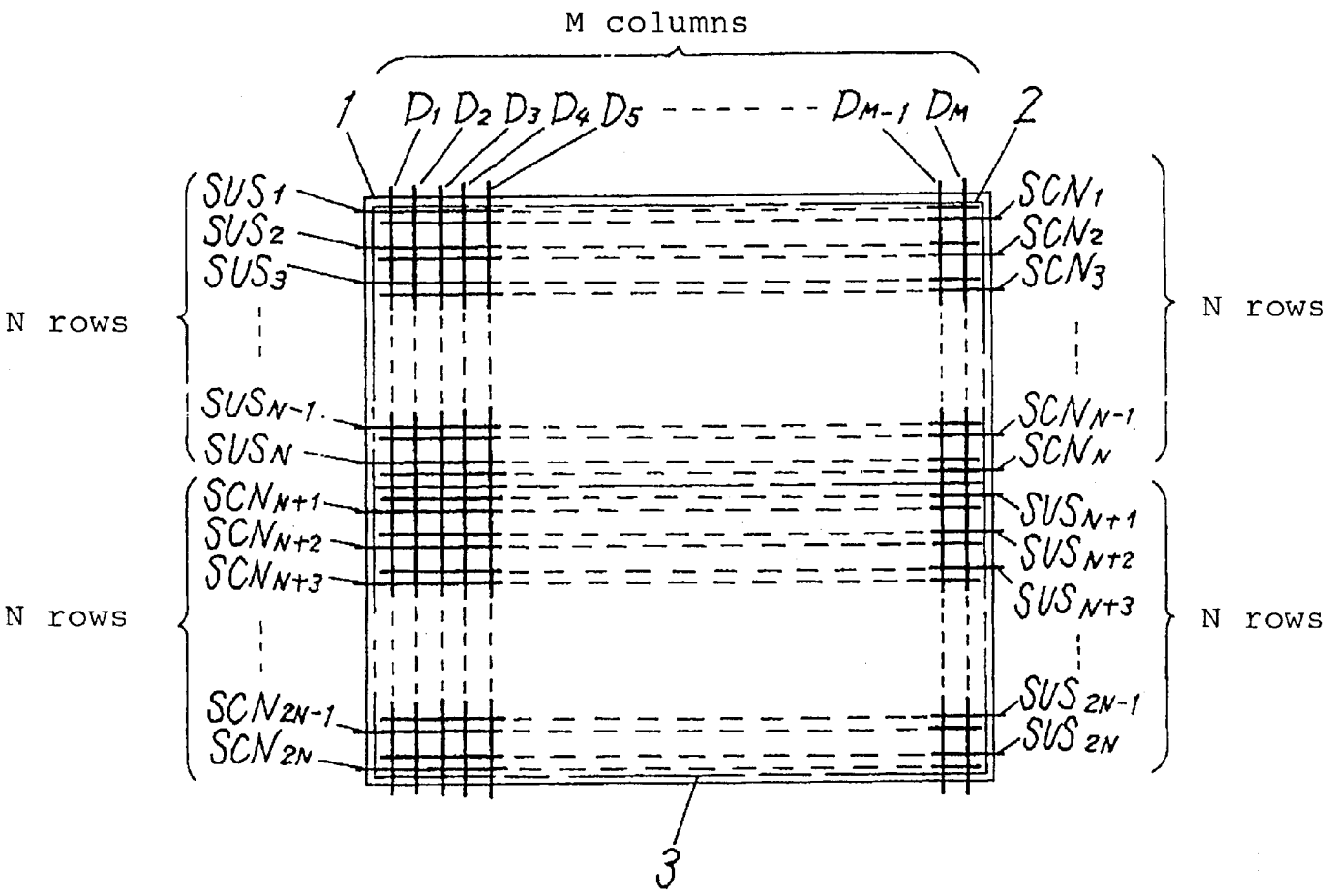
FIG. 4 is an arrangement of electrodes of the second embodiment according to the present invention.
Figure 5:
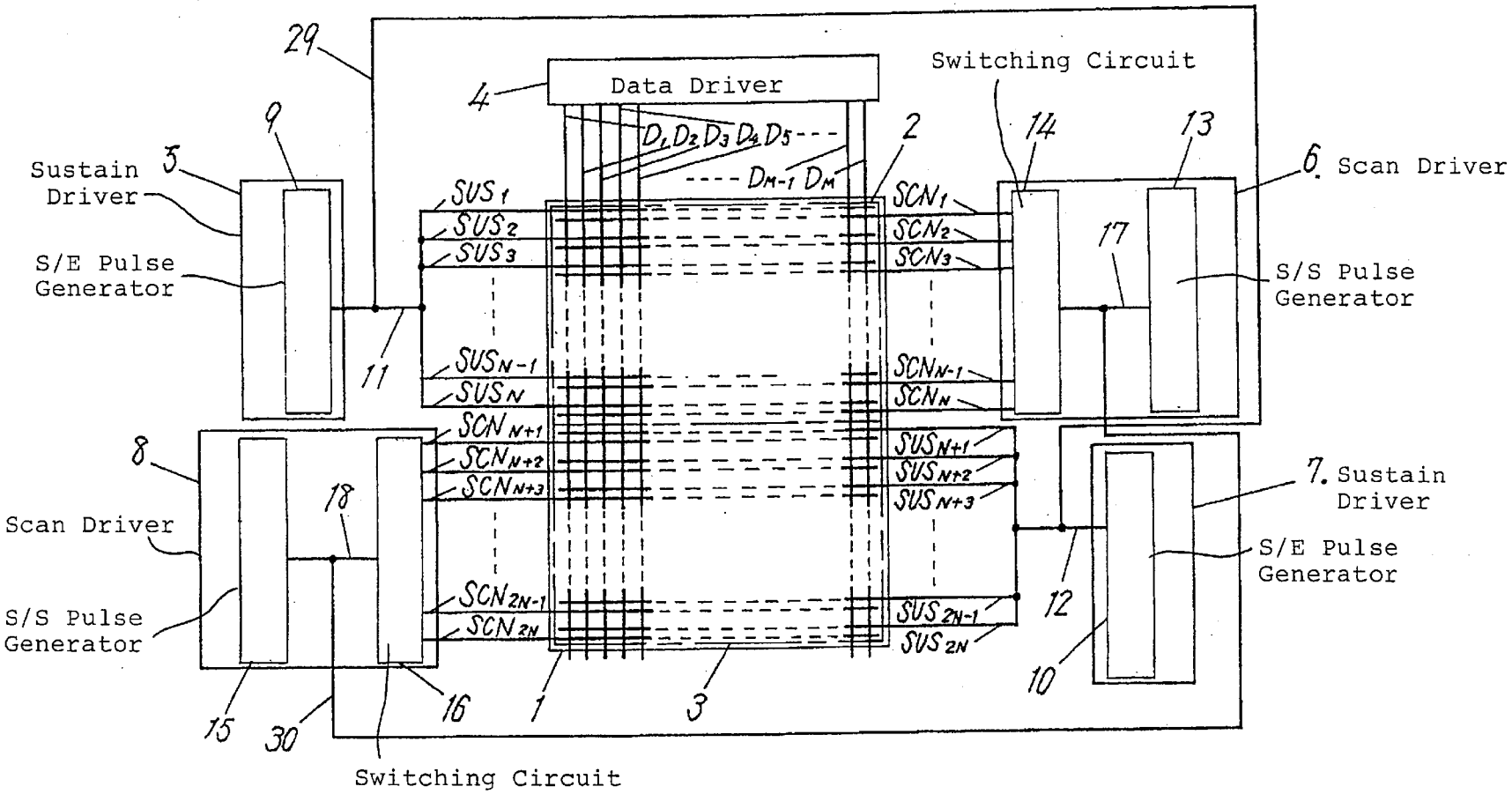
FIG. 5 is a circuit diagram of the AC plasma display device of the second embodiment according to the present invention.

FIG. 4 shows another arrangement of the electrodes for the AC plasma display panel, and FIG. 5 shows an embodiment of the plasma display panel in which the arrangement in FIG. 4 is installed. As can be seen from the drawings, in the electrode arrangement of this embodiment, the sustain electrodes $SUS_{1-N}$ and scan electrodes $SCN_{1-N}$, in the first group 2 are extended out to the left and right sides, respectively. On the other hand, the sustain electrodes $SUS_{(N+1)-2N}$ and scan electrodes $SCN_{(N+1)-2N}$ in the second group 3 are extended out to the right and left sides, respectively.

In accordance with this arrangement, the sustaining electrode driver 5 and scan electrode driver 6 for the first group 2 are positioned on the left and right sides and adjacent to the extended-out portions of the corresponding electrodes $SUS_{1-N}$ and $SCN_{1-N}$, respectively. Also, the sustaining electrode driver 7 and scan electrode driver 8 for the second group 3 are positioned on the right and left sides and adjacent to the extended-out portions of the corresponding electrodes $SUS_{(N+1)-2N}$ and $SCN_{(N+1)-2N}$ respectively. Further, the output lines 11 and 12 of the S/E pulse generator 9 and 10 are connected to each other through the bypass line 29, and the output lines 17 and 18 of the S/S pulse generator 13 and 15 are connected to each other through the bypass line 30. This results in the same advantages as derived from the first embodiment.

In view of above, according to the embodiments of the present invention, since the AC plasma display panel is provided with two divided sustain and scan drivers, each of these drivers can be mounted on a small circuit board. This small-sized circuit is advantageous in its mounting and assembling on a substrate on which other circuit boards (e.g., power circuit, imaging circuit, and signal processing circuit for driving the panel) should also be mounted.

In the previous embodiments, the S/E pulse generators 9 and 10 and S/S pulse generators 13 and 15 are connected to each other through corresponding output lines, respectively. The present invention is not limited thereto and it may be modified so that the output lines of the sustaining pulse generators in separate sustaining electrode drivers are connected to each other and also the output lines of the sustaining pulse generators in separate scan electrode drivers are connected to each other, which results in the same advantages as the previous embodiments.

Also, the present invention can be employed not only in the AC plasma display panel described above but also in another AC plasma display panel that is different in structure.

Further, the present invention can equally be applied to the electrode arrangement of the panel in which the data electrodes are divided into two or more groups, for example.

Furthermore, the present invention can also be applied to another AC plasma display that operates with different operational process. For example, the polarities of the voltage applied to the electrodes are not limited to the previous embodiments. Also, in addition to the writing-, sustaining-, and erasing-periods, and another operational period; may be provided if necessary.

Moreover, although the pulse generators are mainly constructed with push-pull circuits, they may be formed with different electric elements.

Although in the previous embodiments the driving circuit of the panel is divided into two groups, it may be divided into three or more groups in which each group includes corresponding sustain and scan electrodes. In this variation, the sustain and scan electrodes may be extended out in respective directions. Also, the sustain electrodes may be connected to the corresponding sustaining driver and the scan electrodes to the corresponding scan driver, and the sustain drivers and scan drivers of the groups may be connected to each other through corresponding bypass lines, respectively. This results in the same advantages described in the previous embodiments.

What is claimed is:

1. An AC plasma display device, said device including a pair of spaced apart first and second plates, said first plate bearing a plurality of data electrodes each extending in a first direction and said second plate bearing a plurality of paired first and second electrodes each extending in another direction perpendicular to said first direction so that said data electrodes oppose said first and second electrodes through a discharge chamber and said plurality of paired first and second electrodes being divided into a plurality of groups, said AC plasma display device comprising:

a plurality of connecting lines, each of said connecting lines being associated with said first electrodes in one of said groups;

a plurality of first drivers for driving said first electrodes, each of said first drivers being associated with one of said connecting lines;

a first bypass line connecting said plurality of connecting lines with each other; and a plurality of second drivers for driving said second electrodes, each of said second drivers being associated with second electrodes in one of said plurality of groups.

2. A device in accordance with claim 1, wherein each of said first electrodes in each of said groups is extended out on one side of said second plate, and wherein each of said second electrodes in each of said groups is extended out on the opposite side of said second plate.

3. A device in accordance with claim 1, wherein said first electrodes in one of said groups are extended out on one side of said second plate, wherein said first electrodes in another of said groups are extended out on the opposite side of said second plate, wherein said second electrodes in said one of said groups are extended out on said opposite side of said second plate, and wherein said second electrodes in said another of said groups are extended out on said one side of said second plate.

4. An AC plasma display device comprising:

a display having first and second display regions;

a plurality of pairs of sustaining and scanning electrodes, said plurality of pairs being divided into first and second groups so that said first and second groups being assigned to said first and second display regions, respectively;

a first sustaining electrode driver for driving said sustaining electrodes of said first group;

a second sustaining electrode driver for driving said sustaining electrodes of said second group;

a first connecting line for connecting between said first sustaining driver and said sustaining electrodes of said first group;

a second connecting line for connecting between said first sustaining driver and said sustaining electrodes of said second group;

a bypass line connecting said first and said second connecting lines so as to provide said first and second display regions with the same brightness even if said first region is greater or smaller in size than said second region.

* * * * *